US011346308B1

(12) United States Patent
Dudar

(10) Patent No.: US 11,346,308 B1
(45) Date of Patent: May 31, 2022

(54) METHODS AND SYSTEMS FOR DIAGNOSING DEGRADATION IN A PRESSURE-LESS FUEL TANK

(71) Applicant: Ford Global Technologies, LLC, Dearborn, MI (US)

(72) Inventor: Aed M Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/305,580

(22) Filed: Jul. 9, 2021

(51) Int. Cl.
*F02M 25/08* (2006.01)

(52) U.S. Cl.
CPC .... *F02M 25/0818* (2013.01); *F02M 25/0836* (2013.01)

(58) Field of Classification Search
CPC ..... F02M 25/0818; F02M 25/0836
See application file for complete search history.

(56) References Cited

U.S. PATENT DOCUMENTS

| | | | |
|---|---|---|---|
| 3,693,825 | A | 9/1972 | Richman |
| 6,681,789 | B1 | 1/2004 | Moulis et al. |
| 8,074,627 | B2 | 12/2011 | Siddiqui |
| 9,284,924 | B2 | 3/2016 | Dudar et al. |
| 9,297,340 | B2 | 3/2016 | Pearce et al. |
| 10,077,731 | B2 | 9/2018 | Dudar et al. |
| 10,100,771 | B2 | 10/2018 | Dudar |
| 10,151,265 | B2 | 12/2018 | Dudar |
| 10,451,010 | B2 | 10/2019 | Dudar |
| 2004/0250795 | A1 | 12/2004 | Stroia et al. |
| 2011/0139130 | A1 | 6/2011 | Siddiqui |
| 2015/0082866 | A1* | 3/2015 | Pearce ..... F02M 25/0809 73/40 |
| 2016/0298576 | A1 | 10/2016 | Reddy et al. |
| 2019/0249622 | A1* | 8/2019 | Dudar ..... B60K 15/03519 |

FOREIGN PATENT DOCUMENTS

JP H1134675 A 2/1999

OTHER PUBLICATIONS

Dudar, A., "Methods and Systems for Diagnosing Degradation in Pressureless Fuel Tank," U.S. Appl. No. 17/222,595, filed Apr. 5, 2021, 68 pages.

* cited by examiner

*Primary Examiner* — Xiao En Mo
(74) *Attorney, Agent, or Firm* — Geoffrey Brumbaugh; McCoy Russell LLP

(57) ABSTRACT

Methods and systems are provided for diagnosing degradation in a variable volume device included within a pressure-less fuel tank. In one example, a method may include, upon conditions being met, operating a pump of an evaporative emissions control (EVAP) system leak detection module (ELCM) to evacuate the variable volume device. A degradation of the variable volume device may be indicated based on a change in pressure at the variable volume device.

20 Claims, 8 Drawing Sheets

METHODS AND SYSTEMS FOR DIAGNOSING DEGRADATION IN A PRESSURE-LESS FUEL TANK

FIELD

The present description relates generally to methods and systems for diagnosing degradation in a fuel system, and particularly for detecting leaks in a bellows included in a pressure-less fuel tank.

BACKGROUND/SUMMARY

Vehicles, such as plug-in hybrid electric vehicles (PHEVs), may include a fuel system in which a fuel tank may be fluidically coupled to a fuel vapor canister of an evaporative emissions control (EVAP) system for storing, filtering, and venting fuel vapors from the fuel tank. The fuel tank may be isolatable from the fuel vapor canister via a fuel tank isolation valve (FTIV) such that only fuel vapors from select events may be present in a given volume (e.g., the fuel tank or the fuel vapor canister). For example, the fuel tank may trap diurnal fuel vapors (that is, from diurnal temperature cycles) and "running loss" fuel vapors (that is, from fuel vaporized during vehicle operation), and the fuel vapor canister may adsorb depressurization fuel vapors (that is, fuel vapors depressurized from the fuel tank to prevent overpressure) and refueling fuel vapors (that is, fuel vapors diverted during refilling of the fuel tank). Further, when a pressure gradient is generated due to a relatively low pressure in either an intake manifold of the vehicle or the fuel tank, fuel vapors may be passively purged from the fuel vapor canister.

Such fuel systems are sometimes referred to as non-integrated refueling canister-only systems (NIRCOSs). To control the various venting and flow paths for the fuel vapors during different modes of vehicle operation, actuation of valve and locking systems (including the FTIV) may be enabled such that no single volume in the NIRCOS is overwhelmed with excess fuel vapor pressure and that any such excess fuel vapor pressure is released. To ensure component reliability in extreme fuel vapor pressure scenarios (e.g., excess fuel vapor pressure or excess vacuum), components of the fuel system may be specially reinforced. For example, the fuel tank may be constructed from heavy steel and may include a number of standoffs supporting opposing walls of the fuel tank. To further mitigate component degradation, depressurization or venting of the fuel tank and/or the fuel vapor canister may be executed on a timescale ranging from a few seconds to a few minutes (e.g., depending on ambient conditions).

However, particularly lengthy depressurization/venting may result in operator frustration or confusion, as the excess fuel vapor pressure needs to be evacuated prior to opening a refueling inlet to the atmosphere. Additionally, the extra hardware used to seal and depressurize the fuel tank adds cost to the system. One approach to reducing the depressurization time and cost is to use a sealed but "pressure-less" fuel tank with a built-in variable volume device (e.g., a bellows) that expands and contracts to relieve vacuum and pressure buildups, thereby eliminating pressurization hardware and reducing costs as shown by Moulis et al. in U.S. Pat. No. 6,681,789.

However, the inventors herein have recognized potential issues with such systems. For instance, as the bellows vents via an atmospheric port, a degradation in the bellows may result in undetected increased evaporative emissions. Moulis et al. do not show a method to diagnose robustness of the bellows.

In one example, the issues described above may be addressed by a method for an engine, comprising: operating a pump of an evaporative emissions control (EVAP) system leak detection module (ELCM), and detecting degradation of a bellows within a fuel tank based on a change in pressure at the bellows. In this way, by operating an existing ELCM during engine key-off conditions, it is possible to effectively detect a degradation/leak in the bellows without installing additional specialized components beyond what is already provided in the vehicle.

As one example, a vapor line may be configured to couple an atmospheric port of the NIRCOS to a vent line of the EVAP system upstream of the ELCM system. A first valve (V1) may be positioned on the vapor line to fluidically connect/disconnect the bellows of the fuel tank to a second valve (V2) housed in the vent line. The second valve may be adjusted to connect the ELCM system to either the fuel vapor canister or to the bellows via the vapor line. During an engine key-off condition, V2 is opened to couple the ELCM system to the vapor line and V1 is closed to isolate the bellows from the ELCM system. The pump of the ELCM system is operated to evacuate the vapor line until a first threshold pressure is attained. Upon reaching the first threshold pressure, V2 is opened to establish fluidic communication between the ELCM pump and the bellows, and the pump may evacuate the bellows. Based on ambient conditions and the material of the bellows, the bellows may be stiff or compliant. If the bellows is stiff and non-degraded, the pressure monitored by an ELCM pressure sensor may record the pressure at the bellows reducing to a second threshold pressure while the pressure in the fuel tank (as estimated via a separate fuel tank pressure sensor) may remain substantially constant. If the bellows is stiff and degraded, the pressure at the bellows may not reduce to the second threshold pressure and the fuel tank pressure may follow the pressure at the bellows. If the bellows is compliant and non-degraded, the pressure at the bellows may reduce to the second threshold pressure in steps while the pressure in the fuel tank decreases. If the bellows is compliant and degraded, the pressure at the bellows may not reduce to the second threshold pressure and the fuel tank pressure may follow the pressure at the bellows.

In this way, by opportunistically using an existing component such as an ELCM system, diagnostics of a pressure-less fuel tank may be carried out and degradation of the bellows may be detected. The technical effect of carrying out diagnostics of the bellows is that undesired emissions of fuel vapor from a degraded bellows may be detected and mitigation steps may be carried out. Overall, by providing a reliable diagnostic routine for detection of degradation/leaks in bellows that will meet current and future degradation detection regulations, a transition from higher-cost pressurized fuel tank systems to less costly pressure-less fuel tank systems may be facilitated.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
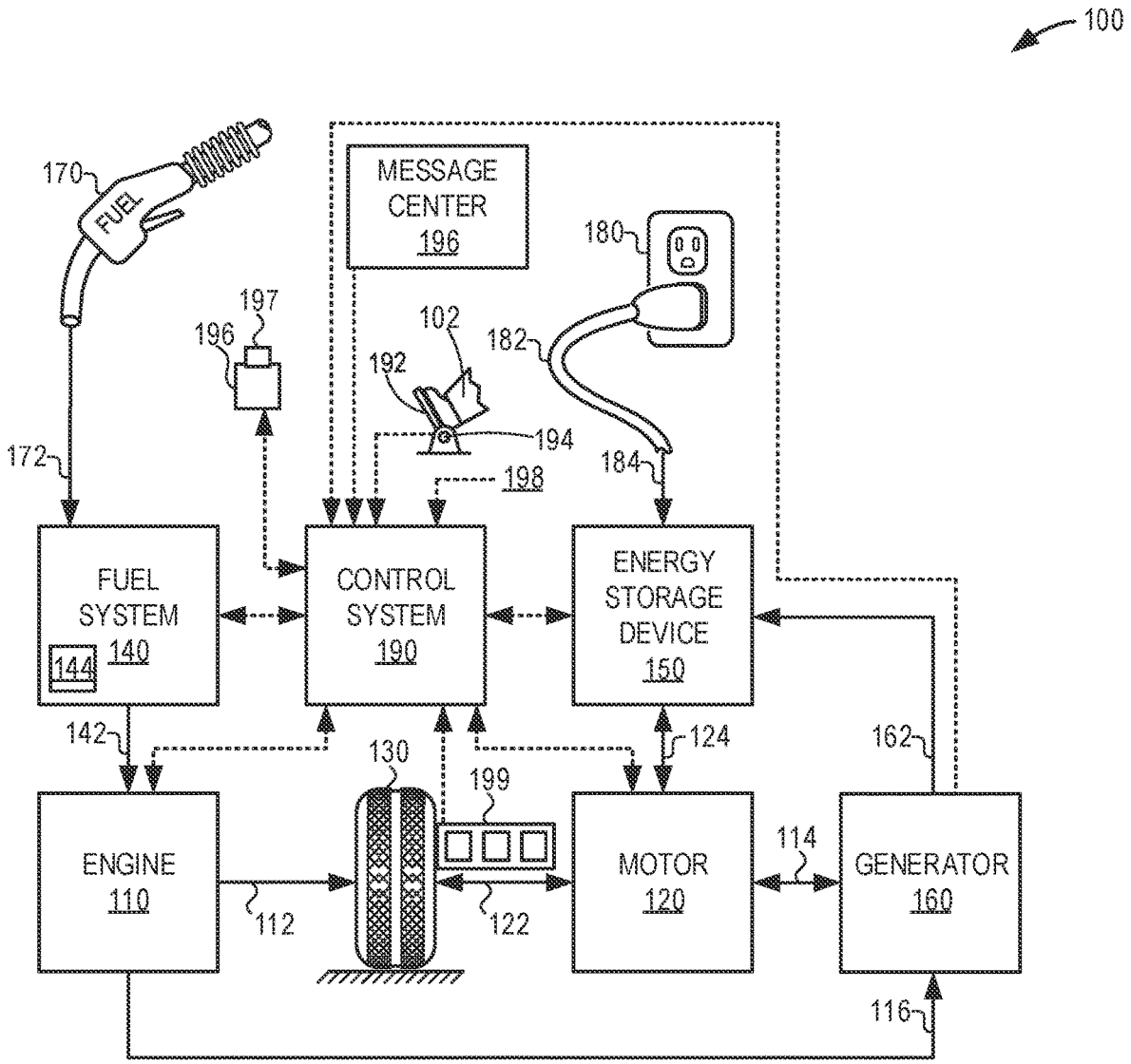
FIG. 1 shows a high-level block diagram illustrating an example vehicle system.
Figure 2:
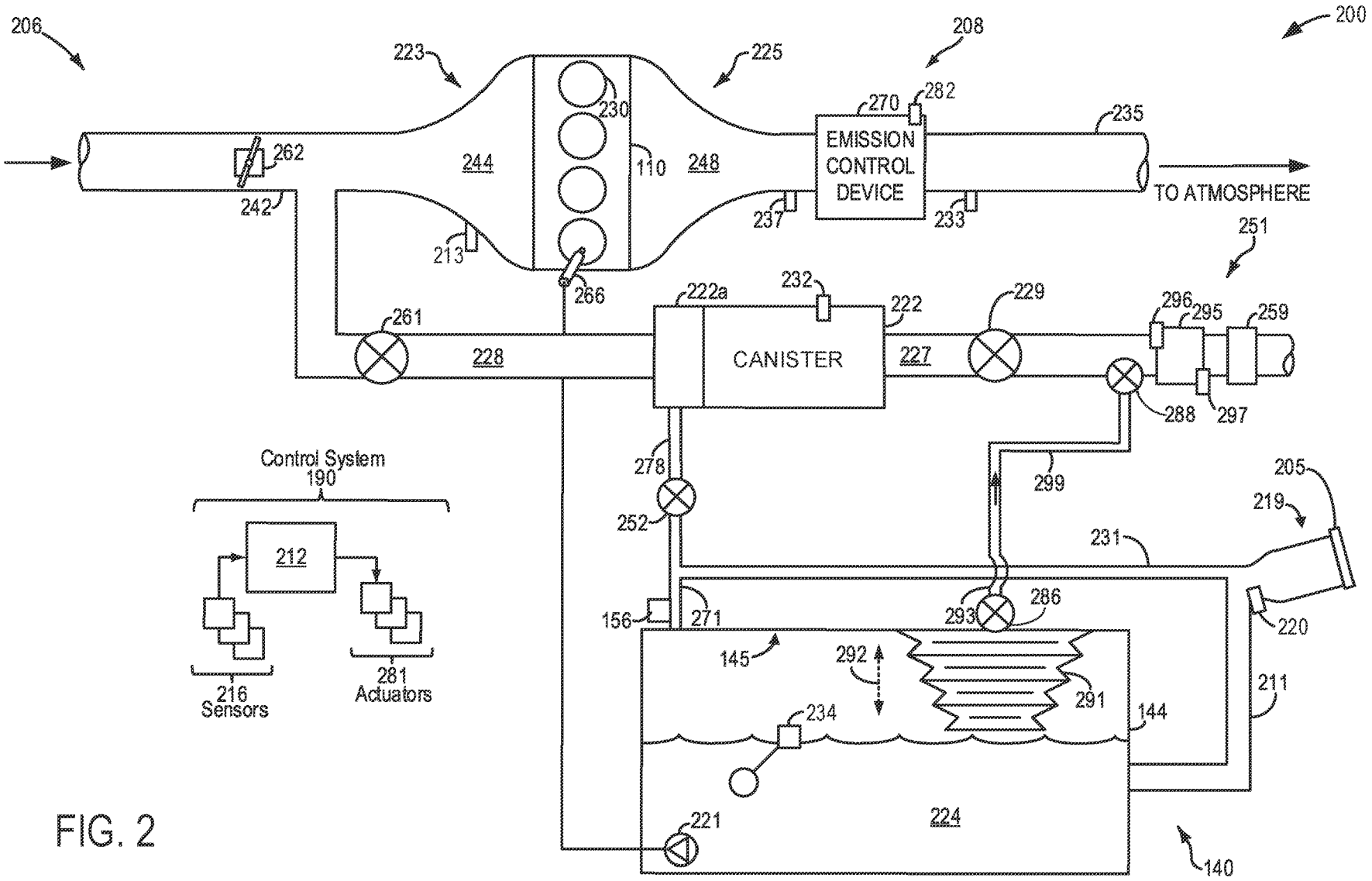
FIG. 2 shows a schematic diagram of a fuel system and an evaporative emissions control system including in the example vehicle system of FIG. 1.
Figure 3B:
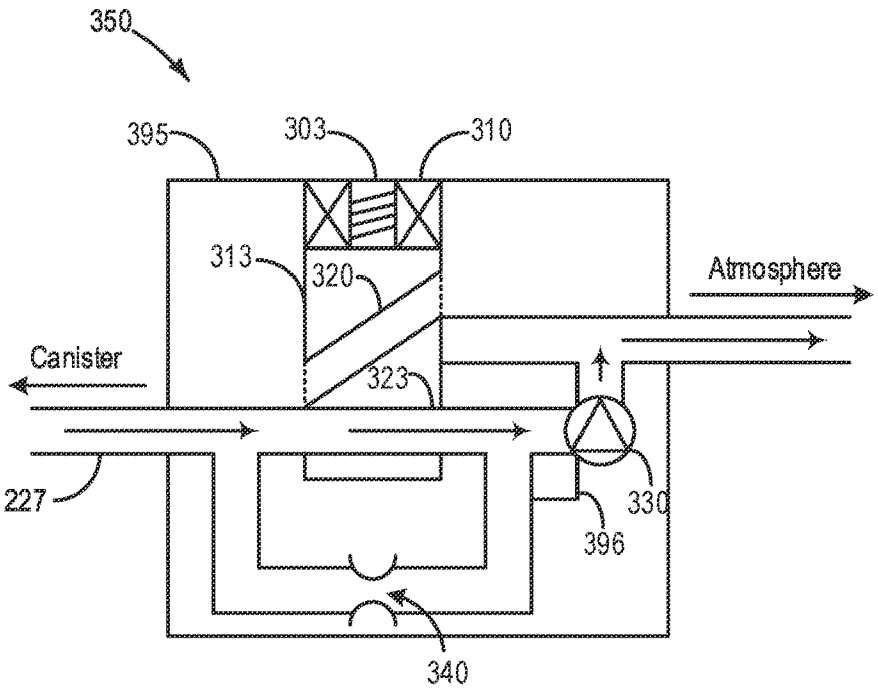
FIG. 3B shows a schematic depiction of an evaporative leak check module in a configuration to apply a vacuum to a bellows included in a fuel tank of the fuel system.
Figure 3A:
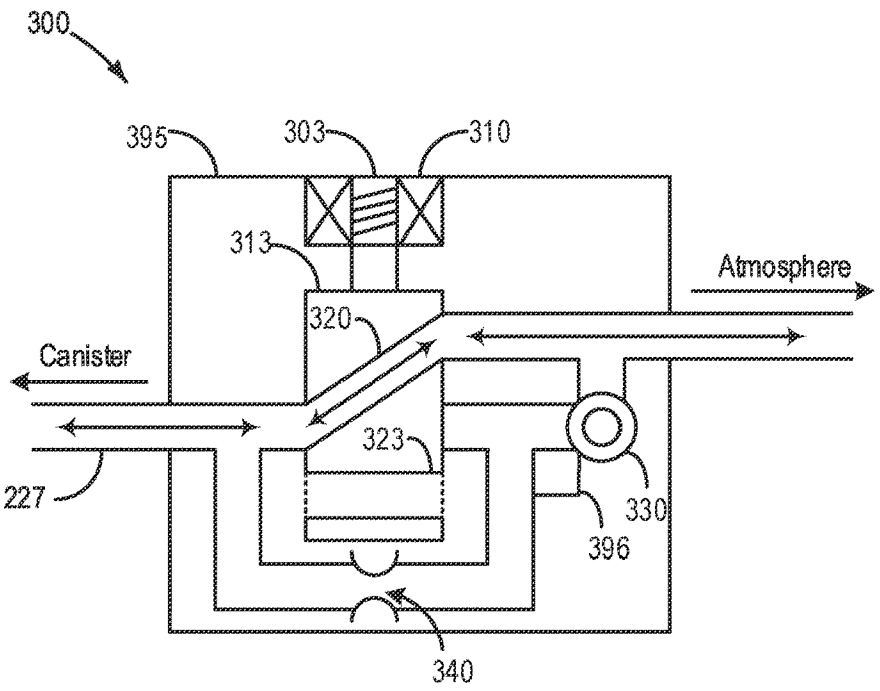
FIG. 3A shows a schematic depiction of the evaporative leak check module in a configuration where a fuel vapor canister is vented to atmosphere.
Figure 4A:
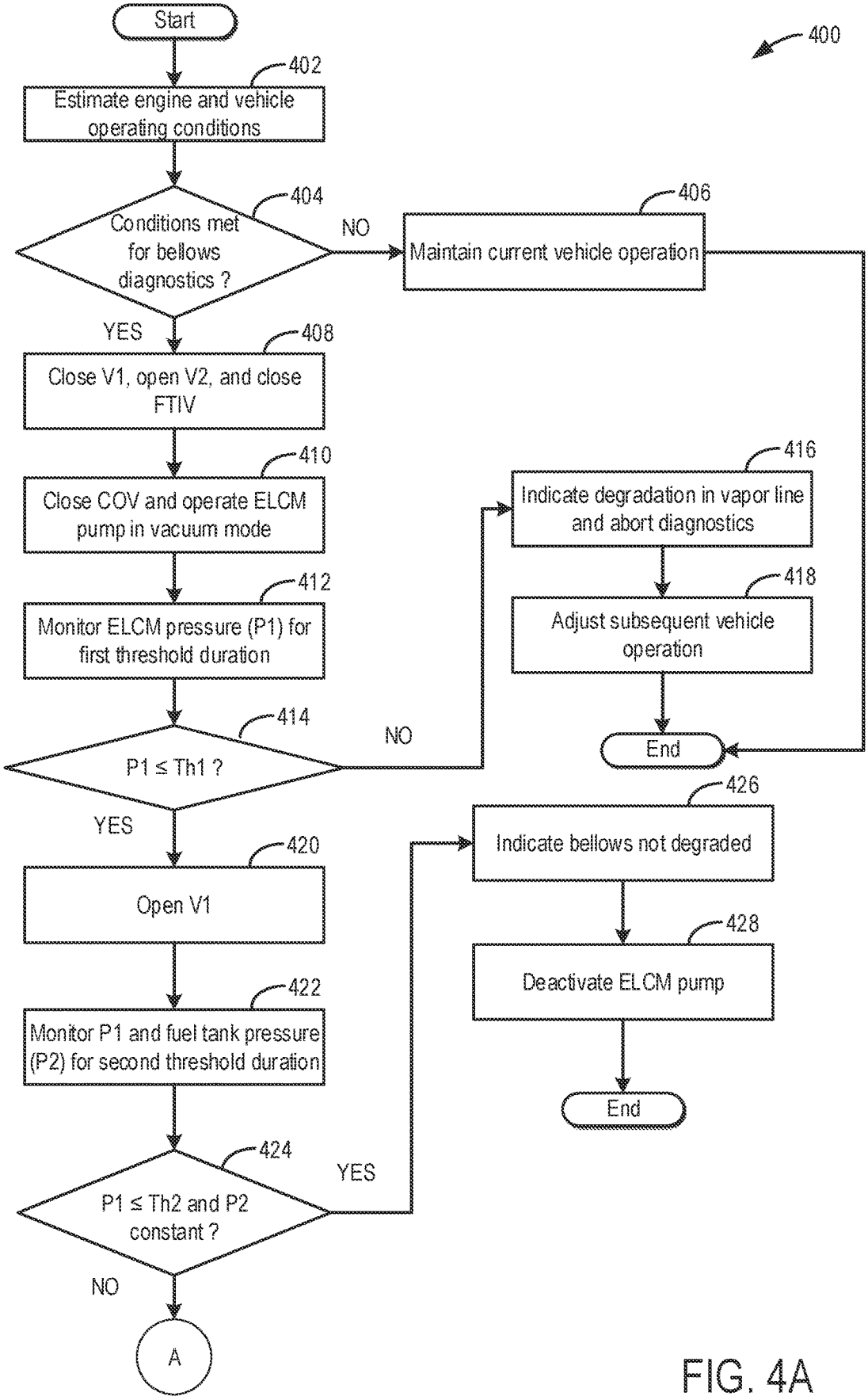
FIG. 4A shows a first part of a high level flow chart of an example method for diagnosing the bellows included in the fuel tank.
Figure 4B:
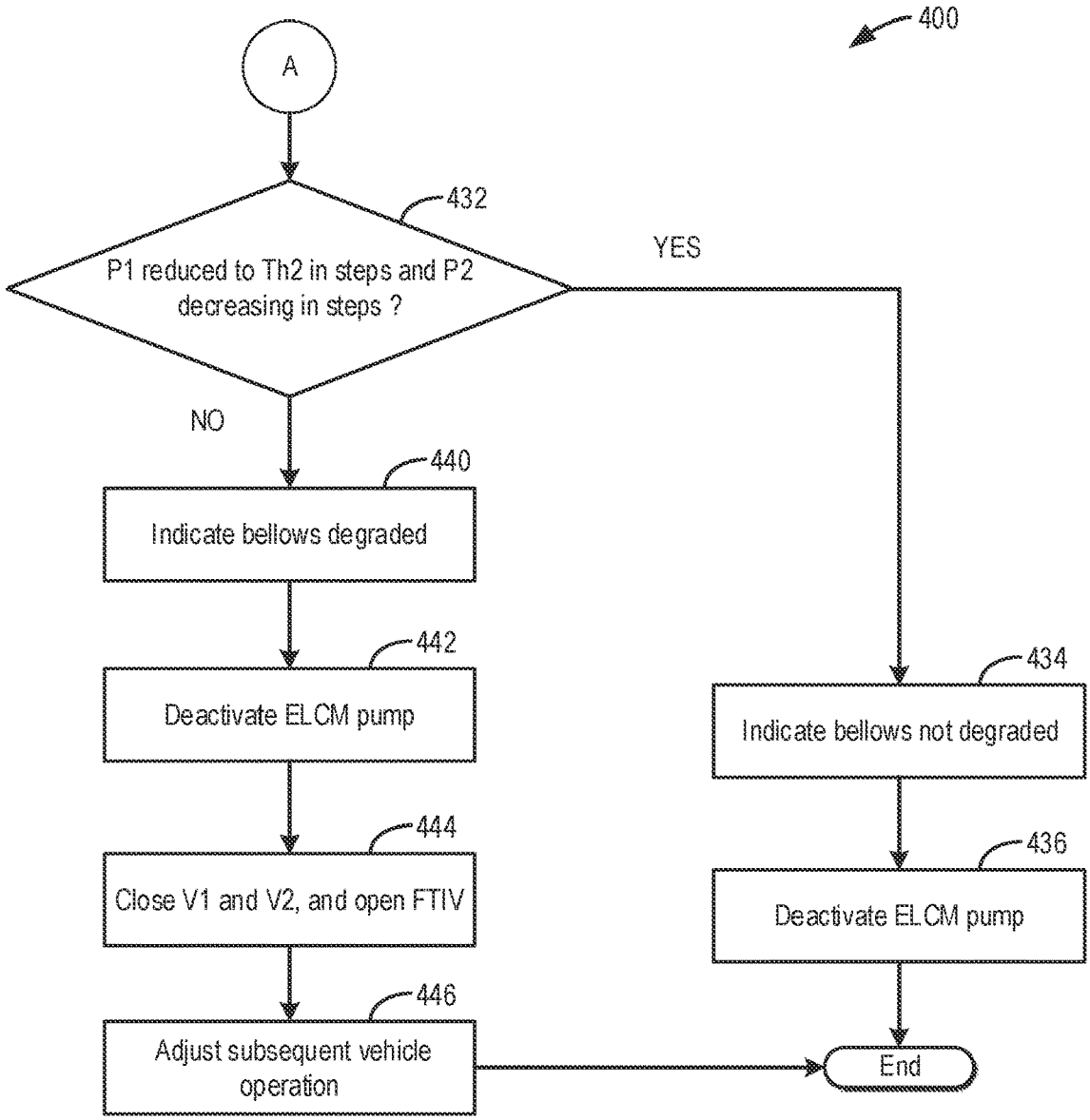
FIG. 4B shows a second part of the high level flow chart of the example method for diagnosing the bellows included in the fuel tank.
Figure 5:
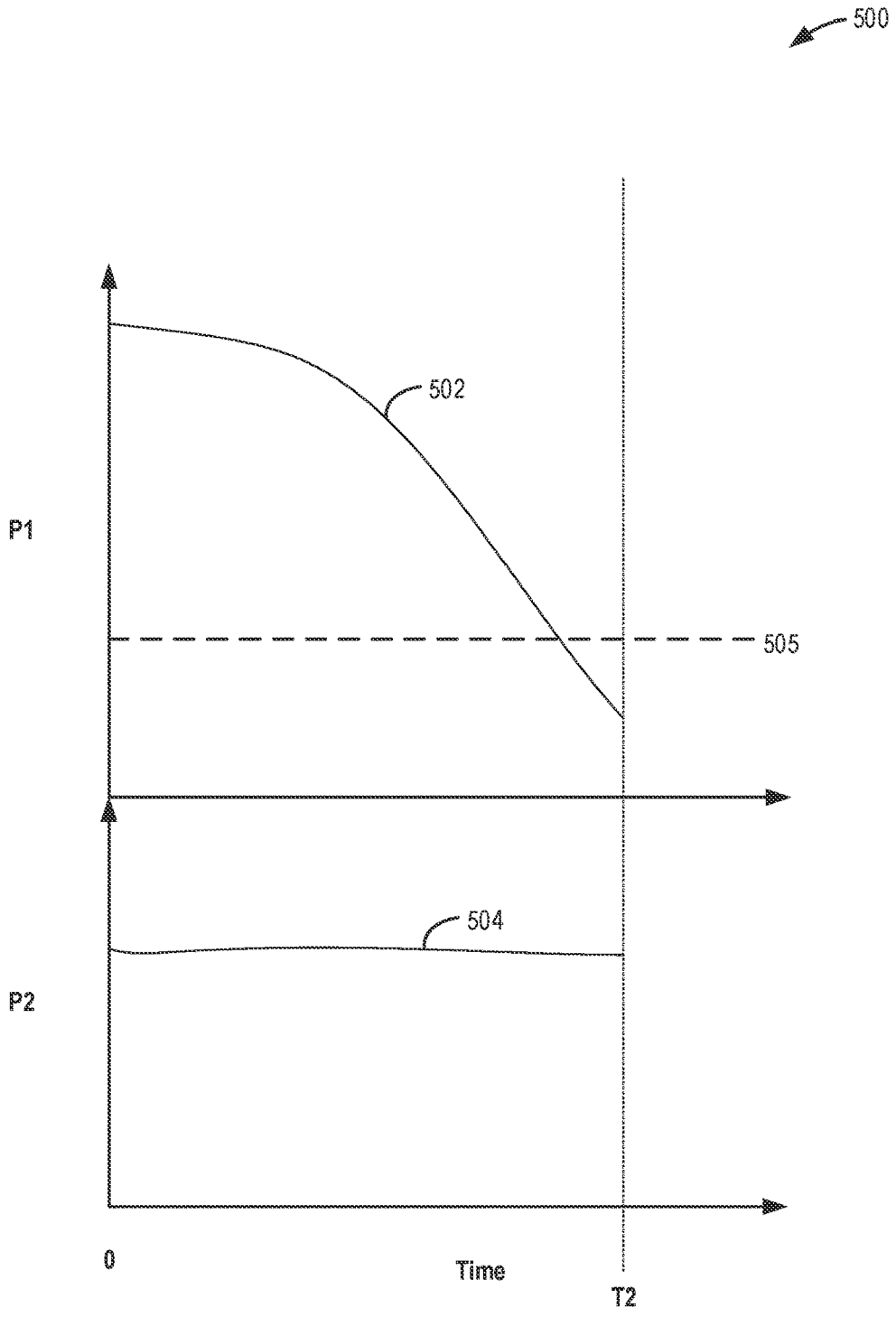
FIG. 5 shows an example plot of change in pressure in a stiff bellows during the diagnostic routine.
Figure 6:
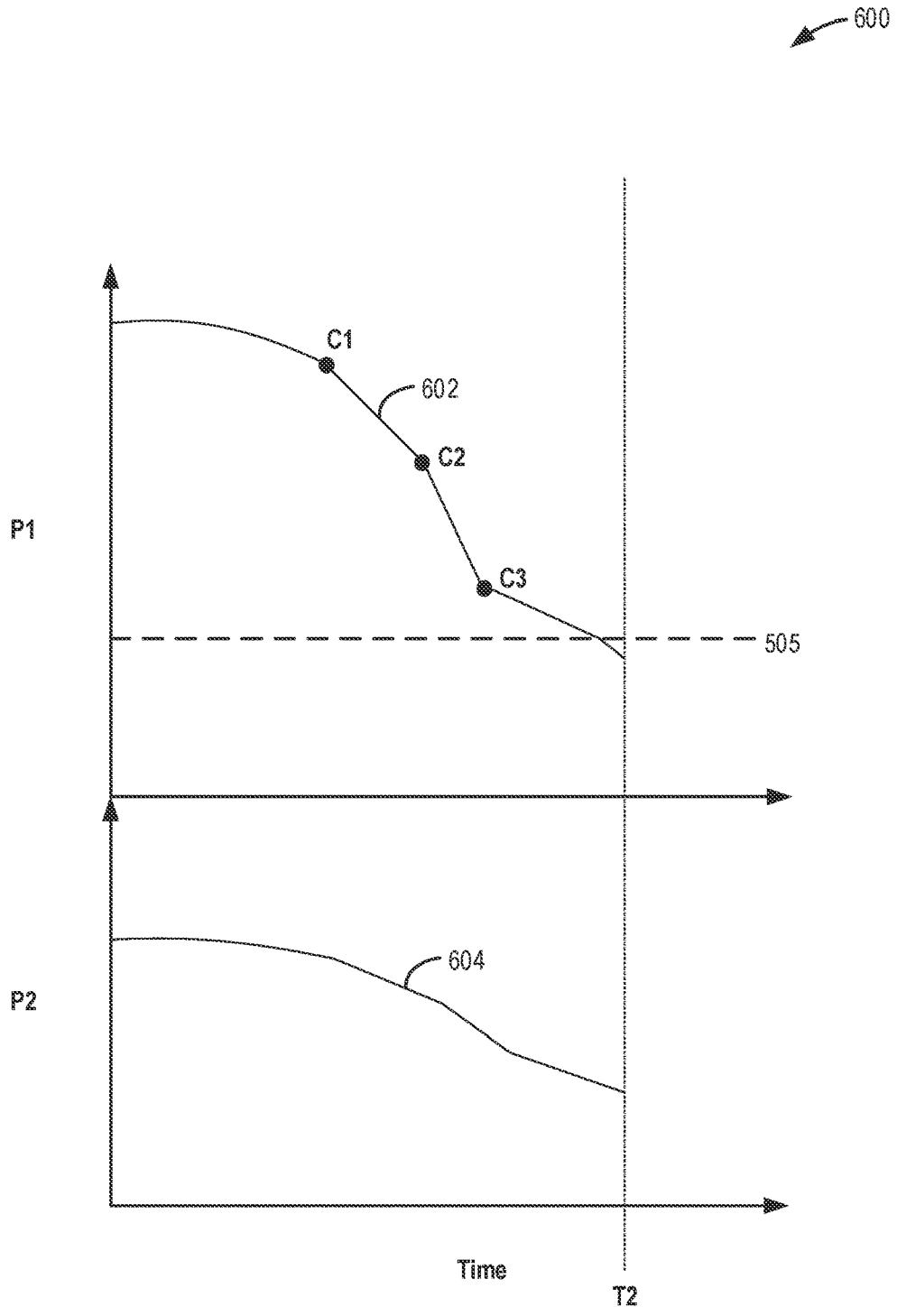
FIG. 6 shows an example plot of change in pressure in a compliant bellows during the diagnostic routine.
Figure 7:
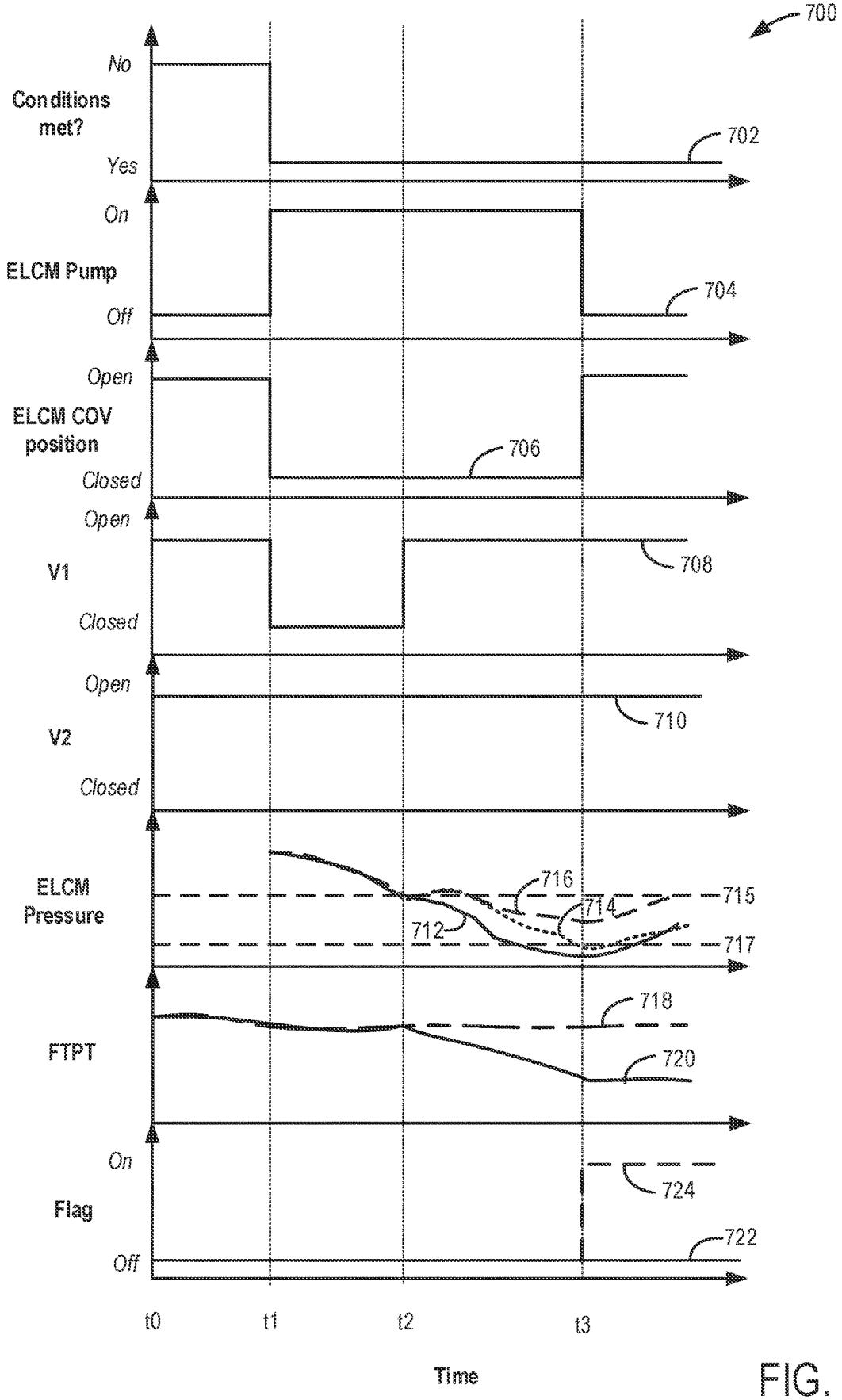
FIG. 7 shows an example diagnostic of the bellows during an engine-off condition.

The following description relates to methods and systems for diagnosing degradation of components of a fuel system coupled to an engine, such as the fuel system and the engine included in the vehicle system of FIGS. 1 and 2. The fuel system may be coupled to an evaporative emissions control (EVAP) system for storing, filtering, and venting fuel vapors from the fuel tank, the EVAP system further including an evaporative leak check module (ELCM) for diagnostics of the EVAP system. Configurations of the ELCM are shown in FIGS. 3A, 3B. The fuel system component diagnosed may be a variable volume device such as a bellows included in a fuel tank. A control routine such as shown in FIGS. 4A, 4B may be implemented by a controller included in the vehicle system to opportunistically carry out the diagnostic routine during engine off conditions. A change in pressure with the bellows during the diagnostic routine may be different for a stiff bellows and a compliant bellows, as shown in FIGS. 5, 6. The controller may be configured to notify a vehicle operator of a degradation in the fuel system. Further, FIG. 7 provides a graphical display of an exemplary diagnostic of the fuel system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122, where the motor may convert the kinetic energy of the vehicle to electrical energy for storage at energy storage device 150 as indicated by arrow 124. This operation may be referred to as regenerative braking of the vehicle. Thus, motor 120 may provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

The fuel tank 144 may be a sealed pressure-less non-integrated refueling canister-only systems (NIRCOS) fuel tank including a built-in variable volume device (e.g., a bellows) that expands and contracts to relieve vacuum and pressure buildups. The bellows may change size to maintain the fuel tank at atmospheric pressure. By maintaining the fuel tank at atmospheric pressure, unsealing of the fuel tank during a refueling request may be expedited without the additional time needed for venting of the tank in a pressurized NIRCOS fuel tank.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of the engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may be disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle, such as from solar or wind energy. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

Referring now to FIG. 2, a schematic diagram 200 depicting a vehicle system 206 is shown. In some examples, vehicle system 206 may be an HEV system, such as a PHEV system. For example, vehicle system 206 may be the same as vehicle propulsion system 100 of FIG. 1. However, in other examples, vehicle system 206 may be implemented in a non-hybrid vehicle (e.g., a vehicle equipped with an engine and without a motor operable to at least partially propel the vehicle).

Vehicle system 206 may include an engine system 208 coupled to each of an evaporative emissions control system 251 and fuel system 140. Engine system 208 may include engine 110 having a plurality of cylinders 230. Engine 110 may include an engine air intake system 223 and an engine exhaust system 225. Engine air intake system 223 may include a throttle 262 in fluidic communication with an engine intake manifold 244 via an intake passage 242. Further, engine air intake system 223 may include an air box and filter (not shown) positioned upstream of throttle 262. Engine exhaust system 225 may include an exhaust manifold 248 leading to an exhaust passage 235 that routes exhaust gas to the atmosphere. Engine exhaust system 225 may include an emission control device 270, which in one example may be mounted in a close-coupled position in exhaust passage 235 (e.g., closer to engine 110 than an outlet of exhaust passage 235) and may include one or more exhaust catalysts. For instance, emission control device 270 may include one or more of a three-way catalyst, a lean nitrogen oxide ($NO_x$) trap, a diesel particulate filter, an oxidation catalyst, etc. In some examples, an electric heater 282 may be coupled to emission control device 270, and utilized to heat emission control device 270 to or beyond a predetermined temperature (e.g., a light-off temperature of emission control device 270).

It will be appreciated that other components may be included in engine system 208 such as a variety of valves and sensors. For example, a barometric pressure sensor 213 may be included in engine air intake system 223. In one example, barometric pressure sensor 213 may be a manifold air pressure (MAP) sensor and may be coupled to engine intake manifold 244 downstream of throttle 262. Barometric pressure sensor 213 may rely on part throttle or full or wide open throttle conditions, e.g., when an opening amount of throttle 262 is greater than a threshold, in order to accurately determine a barometric pressure.

Fuel system 140 may include fuel tank 144 coupled to a fuel pump system 221. Fuel pump system 221 may include one or more pumps for pressurizing fuel delivered to cylinders 230 via fuel injectors 266 during a single cycle of cylinders 230 (while only a single fuel injector 266 is shown at FIG. 2, additional fuel injectors may be provided for each cylinder 230). A distribution or relative amounts of fuel delivered, injection timing, etc. may vary with operating conditions such as engine load, engine knock, exhaust temperature, etc. responsive to different operating or degradation states of fuel system 140, engine 110, etc. A pressure in the fuel system may be estimated via a fuel tank pressure transducer (FTPT) 156. In one example, the FTPT 156 may be included within the fuel tank 144.

Fuel system 140 may be a return-less fuel system, a return fuel system, or any one of various other types of fuel system. Fuel tank 144 may hold a fuel 224 including a plurality of fuel blends, e.g., fuel with a range of alcohol concentrations, such as gasoline, various gasoline-ethanol blends (including E10, E85), etc. A fuel level sensor 234 disposed in fuel tank 144 may provide an indication of the fuel level ("Fuel Level Input") to a controller 212 included in control system 190. As depicted, fuel level sensor 234 may include a float coupled to a variable resistor. Alternatively, other types of fuel level sensors may be used.

Vapors generated in fuel system 140 may be routed to evaporative emissions control system 251 via vapor recovery line 231, before being purged to engine air intake system 223. Vapor recovery line 231 may be coupled to fuel tank 144 via one or more conduits. For example, vapor recovery line 231 may be coupled to fuel tank 144 via at least one conduit 271.

Evaporative emissions control system 251 may further include one or more fuel vapor containers or canisters 222 for capturing and storing fuel vapors. Fuel vapor canister 222 may be coupled to fuel tank 144 via at least one conduit 278 including at least one fuel tank isolation valve (FTIV) 252 for isolating the fuel tank during certain conditions. For example, during engine operation, FTIV 252 may be kept closed to limit the amount of diurnal or "running loss" vapors directed to canister 222 from fuel tank 144. During refueling operations and selected purging conditions, FTIV 252 may be temporarily opened, e.g., for a duration, to direct fuel vapors from the fuel tank 144 to canister 222. Further, FTIV 252 may also be temporarily opened when the fuel tank pressure is higher than a threshold (e.g., above a mechanical pressure limit of the fuel tank), such that fuel vapors may be released into the canister 222 and the fuel tank pressure is maintained below the threshold.

In some examples, vapor recovery line 231 may be coupled to a fuel tank refilling or refueling system 219. In some examples, refueling system 219 may include a fuel cap 205 for sealing off the refueling system from the atmosphere. Refueling system 219 may be coupled to fuel tank 144 via a fuel filler pipe or neck 211. In some examples, fuel filler pipe 211 may include a flow meter sensor 220 operable to monitor a flow of fuel being supplied to fuel tank 144 via the fuel filler pipe (e.g., during refueling).

During refueling, fuel cap 205 may be manually opened or may be automatically opened responsive to a refueling request received at controller 212. A fuel dispensing device (e.g., 170) may be received by, and thereafter fluidically coupled to, refueling system 219, whereby fuel may be supplied to fuel tank 144 via fuel filler pipe 211. Refueling may continue until the fuel dispensing device is manually shut off or until fuel tank 144 is filled to a threshold fuel level (e.g., until feedback from fuel level sensor 234 indicates the threshold fuel level has been reached), at which point a mechanical or otherwise automated stop of the fuel dispensing device may be triggered.

Evaporative emissions control system 251 may include one or more emissions control devices, such as fuel vapor canister 222 filled with an appropriate adsorbent, the fuel vapor canister being configured to temporarily trap fuel vapors (including vaporized hydrocarbons) during refueling operations. In one example, the adsorbent used may be activated charcoal. Evaporative emissions control system 251 may further include a canister ventilation path or vent line 227 which may route gases out of fuel vapor canister 222 to the atmosphere when storing, or trapping, fuel vapors from fuel system 140.

Fuel vapor canister 222 may include a buffer **222*a* (or buffer region), each of the fuel vapor canister and the buffer including the adsorbent. As shown, a volume of buffer 222*a* may be smaller than (e.g., a fraction of) a volume of fuel vapor canister 222. The adsorbent in buffer 222*a* may be the same as, or different from, the adsorbent in fuel vapor canister 222 (e.g., both may include charcoal). Buffer 222*a* may be positioned within fuel vapor canister 222 such that, during canister loading, fuel tank vapors may first be adsorbed within the buffer, and then when the buffer is saturated, further fuel tank vapors may be adsorbed in a remaining volume of the fuel vapor canister. In comparison, during purging of fuel vapor canister 222, fuel vapors may first be desorbed from the fuel vapor canister (e.g., to a threshold amount) before being desorbed from buffer 222*a*. In other words, loading and unloading of buffer 222*a* may not be linear with loading and unloading of fuel vapor canister 222. As such, one effect of buffer 222*a* is to dampen any fuel vapor spikes flowing from fuel tank 144 to fuel vapor canister 222, thereby reducing a possibility of any fuel vapor spikes going to engine 110**.

In some examples, one or more temperature sensors 232 may be coupled to and/or within fuel vapor canister 222. As fuel vapor is adsorbed by the adsorbent in fuel vapor canister 222, heat may be generated (heat of adsorption). Likewise, as fuel vapor is desorbed by the adsorbent in fuel vapor canister 222, heat may be consumed. In this way, the adsorption and desorption of fuel vapor by fuel vapor canister 222 may be monitored and estimated based on temperature changes within the fuel vapor canister.

Vent line 227 may also allow fresh air to be drawn into fuel vapor canister 222 when purging stored fuel vapors from fuel system 140 to engine air intake system 223 via purge line 228 and purge valve 261. For example, purge valve 261 may normally be closed but may be opened during certain conditions so that vacuum from engine intake manifold 244 may be provided to fuel vapor canister 222 for purging. In some examples, vent line 227 may further include an air filter 259 disposed therein downstream of fuel vapor canister 222.

Flow of air and vapors between fuel vapor canister 222 and the atmosphere may be regulated by a canister vent valve 229. Canister vent valve 229 may be a normally open valve, so that FTIV 252 may control venting of fuel tank 144 with the atmosphere. As described above, FTIV 252 may be positioned between fuel tank 144 and fuel vapor canister 222 within conduit 278. In a NIRCOS fuel system, the FTIV 252 may be a normally closed valve, that when opened during conditions such as refueling, allows for venting of fuel vapors from fuel tank 144 to fuel vapor canister 222. FTIV 252 may also be opened upon the pressure in the fuel tank 144 increasing to a threshold pressure. Fuel vapors may then be vented to atmosphere via canister vent valve 229, or purged to engine air intake system 223 via canister purge valve 261.

In some examples, evaporative emissions control system 251 may further include an evaporative level check monitor (ELCM) 295. ELCM 295 may be disposed in vent line 227 and may be configured to control venting and/or assist in detection of undesired evaporative emissions. As an example, ELCM 295 may include a vacuum pump for applying negative pressure to the fuel system when administering a test for undesired evaporative emissions. In some embodiments, the vacuum pump may be configured to be reversible. In other words, the vacuum pump may be configured to apply either a negative pressure or a positive pressure on the evaporative emissions control system 251 and fuel system 140. ELCM 295 may further include a reference orifice (not shown), a pressure sensor 297, and a changeover valve (COV) 296. A reference check may thus be performed whereby a vacuum may be drawn across the reference orifice, where the resulting vacuum level comprises a vacuum level indicative of an absence of undesired evaporative emissions. For example, following the reference check, the fuel system 140 and evaporative emissions control system 251 may be evacuated by the ELCM vacuum pump. In the absence of undesired evaporative emissions, the vacuum may pull down to the reference check vacuum level. Alternatively, in the presence of undesired evaporative emissions, the vacuum may not pull down to the reference check vacuum level.

During select engine and/or vehicle operating conditions, such as after an emission control device light-off temperature has been attained (e.g., a threshold temperature reached after warming up from ambient temperature) and with the engine running, the controller 212 may control the ELCM 295 changeover valve (COV) 296 to enable fuel vapor canister 222 to be fluidically coupled to atmosphere. For example, ELCM COV 296 may be configured in a first position (e.g. opened), where the first position includes the fuel vapor canister 222 fluidically coupled to atmosphere, except during pressure tests performed on the system. In one example, under natural aspiration conditions (e.g. intake manifold vacuum conditions), ELCM COV 296 may be configured in a second position (e.g. closed) to seal the fuel vapor canister 222 from atmosphere. By commanding ELCM COV 296 to the second position, the evaporative emissions control system 251 and fuel system 140 may be evacuated in order to ascertain the presence or absence of undesired evaporative emissions.

Undesired evaporative emission detection routines may be intermittently performed by controller 212 on fuel system 140 to confirm that the fuel system is not degraded. As such, undesired evaporative emission detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, undesired evaporative emission detection routines may be performed while the engine is running by operating a vacuum pump and/or using engine intake manifold vacuum. Undesired evaporative emission tests may be performed by the ELCM 295 communicatively coupled to controller 212. ELCM 295 may further include a reference orifice. Following the application of vacuum to the fuel system, a change in pressure at the reference orifice (e.g., an absolute change or a rate of change) may be monitored via the pressure sensor 297, and compared to a threshold. Based on the comparison, undesired evaporative emissions from the fuel system may be identified. The ELCM vacuum pump may be a reversible vacuum pump, and thus configured to apply a positive pressure to the fuel system when a bridging circuit is reversed placing the pump in a second conformation. Example positions of the ELCM pump are shown in FIGS. 3A, 3B.

Fuel system 140 may be a non-integrated refueling canister-only system (NIRCOS), in that fuel tank 144 may be substantially isolatable from fuel vapor canister 222 such that fuel vapors in fuel tank 144 and fuel vapor canister 222 may be independently controlled as desired (e.g., during refueling). During periods in which fuel tank 144 is fluidically decoupled from fuel vapor canister 222, a fuel vapor pressure may develop within the fuel tank. Accordingly, venting and depressurization control routines are often implemented for NIRCOS fuel tanks, along with structural reinforcement thereof. For example, a given NIRCOS may include numerous valves and venting lines coupled to fuel tank(s) included therein to ensure that any excess fuel vapor pressure is properly evacuated or redistributed. Further, NIRCOS fuel tanks may be constructed of high tensile-strength material, such as heavy steel, and configured with a plurality of standoffs therein, the plurality of standoffs extending between opposing walls of a given NIRCOS fuel tank, such that greater fuel vapor pressures may be withstood without fuel tank degradation.

As an alternative, fuel system 140 may include a bellows 291 to maintain a fuel vapor pressure of fuel tank 144 at, or near, atmospheric pressure. As such, complex structural configurations for managing excess fuel vapor pressure may be obviated. Specifically, bellows 291 may be disposed within and affixed to an upper surface 145 of fuel tank 144 having an atmospheric port 293. The bellows may include collapsible sections with may expand and collapse based on pressure in the fuel tank and within the bellows.

As shown in FIG. 2, the fuel level of fuel 224 in fuel tank 144 may be entirely below bellows 291, such that the (liquid) fuel may not be physically contacting the bellows and the bellows may be in a maximally expanded configuration. As the bellows 291 is contacted by rising fuel 224 during refueling, the bellows may compress along an axis 292 proportionally with an increase in the fuel level in fuel tank 144 (up until the bellows reaches a maximally compressed configuration). During compression, air within bellows 291 may be evacuated via the atmospheric port 293. After refueling and during engine operation, fuel 224 may be provided to engine 110 via actuation of fuel pump system 221, such that the fuel level in fuel tank 144 may fall and bellows 291 may expand proportionally along axis 292 (up until the bellows again attains the maximally expanded configuration). During expansion, a pressure differential may be generated between bellows 291 and the surrounding environment such that air may be induced into the bellows via the atmospheric port 293.

In this way, a variable volume configuration may be provided to fuel tank 144 via expansion and contraction of bellows 291, such that a fuel vapor pressure of the fuel tank may be maintained within a threshold range of a predetermined pressure (e.g., an ambient pressure of the surrounding environment). In some examples, the fuel vapor pressure of fuel tank 144 may be maintained within the threshold range even across widely varying ambient temperatures, such as between 40 and 95° F. As such, fuel tank 144 may be formed from materials having relatively weaker strength compared to NIRCOS fuel tanks described above and including fewer or no standoffs therein. Further, a more simplified configuration of valves and lines may be included in fuel system 140 relative to other NIRCOSs, as complex depressurization/venting routines may be obviated by the presence of bellows 291.

The atmospheric port 293 of the bellows 291 may be routed to the vent line 227 between the canister 222 and the ELCM system 295 of the evaporative emissions control system 251 via a vapor line 299. In the illustrated example, a first end of the vapor line 299 is attached to the atmospheric port 293 of the bellows 291 via a first valve 286 and a second end of the vapor line 299 is attached to the vent line 227 via a second valve 288. This establishes a fluidic communication between the bellows 291 of the fuel tank 144 and the ELCM system 295.

The first valve 286 and the second valve 288 may be maintained in their respective open positions to allow air flow into and out of the bellows 291 via the atmospheric port 293 and the vapor line 299. In one example, the vent valve 229 may be eliminated and the second valve 288 may be housed in the vent line 227 to regulate fluidic communication between the ELCM 295 and the canister 222, and between the ELCM 295 and the bellows 291. As an example, in a first (default) configuration of the second valve 288, the ELCM 295 may be coupled to the canister 222 while, in a second configuration of the second valve 288, the ELCM 295 may be coupled to the bellows 291.

Fuel system 140 may be operated by controller 212 in a plurality of modes by selective adjustment of the various valves (e.g., responsive to the various sensors). For example, fuel system 140 may be operated in a refueling mode (e.g., when refueling is requested by a vehicle operator), wherein controller 212 may close FTIV 252, allowing bellows 291 to maintain the fuel vapor pressure of fuel tank 144 within the threshold range of the predetermined pressure. However, if bellows 291 is compressed to the maximally compressed configuration, and the fuel vapor pressure begins increasing beyond which is manageable by fuel tank 144 (e.g., when the fuel tank becomes undesirably overfilled), fuel system 140 may be operated in a venting mode. In the venting mode, controller 212 may open FTIV 252 and canister vent valve 229, while maintaining canister purge valve 261 closed, to direct refueling vapors into fuel vapor canister 222 while preventing fuel vapors from being directed into engine intake manifold 244 (and thus provide a venting path for fuel vapors). As such, opening FTIV 252 may allow refueling vapors to be stored in fuel vapor canister 222. After refueling is completed, at least FTIV 252 may be closed once again.

As another example, the fuel system may be operated in a canister purging mode (e.g., after a given emission control device light-off temperature has been attained and with engine 110 running), wherein controller 212 may open canister purge valve 261 and canister vent valve 229 while closing FTIV 252. Herein, the vacuum generated by engine intake manifold 244 of (operating) engine 110 may be used to draw fresh air through vent line 227 and through fuel vapor canister 222 to purge stored fuel vapors into engine intake manifold 244. As such, in the canister purging mode, the purged fuel vapors from fuel vapor canister 222 may be combusted in engine 110. The canister purging mode may be continued until an amount or level of stored fuel vapors in fuel vapor canister 222 are below a threshold amount or level.

As another example, the fuel system may be operated during a diagnostics test of a component of the fuel tank 144 (e.g., bellows 291) at engine off event. The pump of the ELCM 295 may be operated during an engine-off condition when fuel contained in the fuel tank 144 is not contacting a surface of the bellows 291. Prior to operating the pump, the COV 296 of the ELCM is closed, and the CVV 229 is closed to isolate the ELCM from the fuel vapor canister 222. Also, the second valve 288 may be opened and the first valve 286 may be closed to fluidically couple the ELCM 295 to the vapor line 299, and then the pump may be activated in a vacuum mode. A pressure at the vapor line 299 may be monitored via the ELCM pressure sensor 297 for a first threshold duration, and in response to the pressure at the vapor line decreasing to a first threshold pressure within the first threshold duration, the first valve 286 may be opened to fluidically couple the bellows 291 to the ELCM, and the change in pressure at the bellows may be monitored via the ELCM pressure sensor for a second threshold duration. In response to the pressure at the vapor line not decreasing to the first threshold pressure within the first threshold duration, degradation of the vapor line 299 may be indicated and diagnostics of the bellows 291 may be discontinued. In response to the pressure at the bellows not reducing to a second threshold pressure within the second threshold duration, degradation of the bellows 291 may be indicated and a diagnostic code may be set. In response to the pressure at the bellows smoothly reducing to the second threshold pressure within the second threshold duration and a fuel tank pressure remaining substantially constant over the second threshold duration, the bellows 291 may be indicated to be stiff and not degraded. In response to the pressure at the bellows reducing to the second threshold pressure within the second threshold duration in steps and the fuel tank pressure reducing over the second threshold duration, the bellows 291 may be indicated to be compliant and not degraded.

Details of the diagnostics routine for the bellows 291 is elaborated in FIGS. 4A-4B. Following the diagnosis, the vehicle operator may be notified with specific maintenance instructions and/or one or more vehicle operating parameters may be altered to mitigate degradation to vehicle performance and component reliability. Adjusting operation of the vehicle includes, during subsequent drive cycles, propelling the vehicle with motor torque and not refilling the fuel tank to above the threshold fuel level. Also, upon confirmation that the bellows 291 is degraded, the first valve 286 may be closed to disable communication between the bellows and the vent line 227, and FTIV 252 may be opened.

Control system 190, including controller 212, is shown receiving information from a plurality of sensors 216 (various examples of which are described herein) and sending control signals to a plurality of actuators 281 (various examples of which are described herein). As one example, sensors 216 may include one or more of exhaust gas sensor 237 located upstream of emission control device 270 in exhaust passage 235, temperature sensor 233 located downstream of emission control device 270 in exhaust passage 235, flow meter sensor 220 located in fuel filler pipe 211, fuel level sensor 234 located in fuel tank 144, temperature sensor 232 located in fuel vapor canister 222, FTPT 156, and ELCM pressure sensor 297. Other sensors such as pressure, temperature, air/fuel ratio, and composition sensors may be coupled to various locations in vehicle system 206. As an additional or alternative example, actuators 281 may include fuel injector 266, throttle 262, FTIV 252, canister purge valve 261, canister vent valve 229, first valve 286 and second valve 288 of the fuel system, and ELCM COV 296.

Controller 212 may receive input data from sensors 216, process the input data, and trigger actuators 281 in response to the processed input data based on instructions or code programmed in non-transitory memory therein, the instructions or code corresponding to one or more control routines.

FIG. 3A shows a first schematic depiction 300 of the evaporative leak check module (ELCM) 395 in a first configuration where a fuel vapor canister (such as canister 222 in FIG. 2) of the evaporative emissions control system is vented to atmosphere. FIG. 3B shows a second schematic depiction 350 of the ELCM 395 in a second configuration. The ELCM 395 in FIGS. 3A,B may be the ELCM 295 in FIG. 2

ELCM 395 includes a changeover valve (COV) 313, a vacuum pump 330, and a pressure sensor 396. Vacuum pump 330 may be a reversible pump, for example, a vane pump. COV 313 may be moveable between a first and a second position. In the first position, as shown in FIG. 3A, air may flow through ELCM 395 via first flow path 320. In the second position, as shown in FIG. 3B, air may flow through ELCM 395 via second flow path 323. The position of COV 313 may be controlled by solenoid 310 via compression spring 303. ELCM 395 may also comprise reference orifice 340. Reference orifice 340 may have a diameter corresponding to the size of a threshold leak to be tested, for example, 0.02". In either the first or second position, pressure sensor 396 may generate a pressure signal reflecting the pressure within ELCM 395. Operation of pump 330 and solenoid 310 may be controlled via signals received from controller 212.

As shown in FIG. 3A, in the first configuration, COV 313 is in the first position, and pump 330 is deactivated. This configuration allows for air to freely flow between atmosphere and the canister via first flow path 320. This configuration may be used during a canister purging operation, for example, or during other conditions where the fuel vapor canister is to be vented to atmosphere. Upon receiving a request for refueling, the COV 313 may be actuated to the first position (first position of ELCM), to facilitate air flow through the canister and venting of the refueling vapor from the fuel tank to the canister.

As shown in FIG. 3B, COV 313 is in the second position, and pump 330 is activated in a first direction. This configuration allows pump 330 to draw a vacuum on fuel system 140 via vent line 227. In examples where fuel system 140 includes FTIV 252, FTIV 252 may be opened to allow pump 330 to draw a vacuum on fuel tank 144. Air flow through ELCM 395 in this configuration is represented by arrows. In this configuration, as pump 330 pulls a vacuum on fuel system 140, the absence of undesired evaporative emissions from the system should allow for the vacuum level in ELCM 395 to reach or exceed the previously determined vacuum threshold using reference orifice 340. In the presence of an evaporative emissions system breach larger than the reference orifice, the pump will not pull down to the reference check vacuum level, and undesired evaporative emissions may be indicated.

In an example, during diagnostics of a fuel system component such as bellows 291 within a fuel tank, the COV 313 is in the second position, and pump 330 is activated in the first direction. The FTIV 252 may be closed, the vent valve 229 may be closed, the first valve 286 may be opened and the second valve 288 may be opened to draw a vacuum on the bellows 291 via the vapor line 299 and the atmospheric port 293. Presence or absence of degradation in the bellows 291 may be determined based on change in pressure at the bellows as recorded by the pressure sensor 396 and the FTPT 156.

In this way, the components of FIGS. 1-3A, 3B enable a system for a vehicle, comprising: a variable volume device disposed within a fuel tank, an atmospheric port of the variable volume device fluidly coupled to a vent line upstream of a leak detection module (ELCM) of an evaporative emissions control (EVAP) system via a vapor line, the vent line coupling a fuel vapor canister of the EVAP to atmosphere, and a controller with computer-readable instructions stored on non-transitory memory which when executed cause the controller to: fluidically couple a pump of the ELCM to the variable volume device via the vapor line, operate the pump to evacuate the variable volume device over a threshold duration, and indicate the variable volume device as robust or degraded based on a first pressure estimated via an ELCM pressure sensor and a second pressure estimated via a fuel tank pressure sensor. The variable volume device may be indicated to be robust in response to the first pressure reducing to a threshold pressure within the threshold duration, and the variable volume device may be indicated to be degraded in response to the first pressure not reducing to the threshold pressure within the threshold duration and a change in the second pressure following a change in the first pressure.

Turning now to FIG. 4A-4B, an example method 400 is shown for diagnosing of a variable volume device such as bellows (such as bellows 291 in FIG. 2) included in a fuel tank during an engine-off condition. Instructions for carrying out method 400 may be executed by a controller based on instructions stored on a memory of the controller and in conjunction with signals received from sensors of the vehicle system, such as the sensors described above with reference to FIGS. 1-2. The controller may employ actuators of the vehicle system to adjust a vehicle display, according to the methods described below.

At 402, the method includes estimating and/or measuring vehicle and engine operating conditions. These include, for example, if the vehicle is propelled via motor torque and/or engine torque, torque demand, manifold pressure, manifold air flow, fuel level in fuel tank, ambient conditions (ambient temperature, pressure, and humidity, for example), engine conditions such as engine speed, engine temperature, engine dilution, etc.

At 404, the routine includes determining if conditions are met for diagnostics of the bellows. The conditions may include an engine-off condition when the vehicle is no longer propelled via engine torque. During an engine-off condition, fuel is not delivered from the fuel tank and a fuel pump may be maintained inactive. The conditions for carrying out the diagnostics routine for the bellows may further include that the fuel level in the fuel tank is below a threshold fuel level. A fuel level at or below the threshold fuel level may ensure that the lower surface of the bellows is not contacting any fuel upon full extension of the bellows. In other words, if the fuel level in the tank is below the threshold level, liquid fuel may not be contacting the bellows. In one example, the threshold fuel level may be 40% of the total capacity (highest permissible fuel level).

If it is determined that the conditions are not met for diagnostics of the bellows, at 406, current vehicle operation may be continued without initiation of diagnostics of the bellows, and the method may end. During the current vehicle operation, based on fuel vapor pressure within the fuel tank, the bellows may expand or contract.

If it is determined that conditions are met for diagnostics of the bellows, at 408, a first valve, V1 (such as first valve 286 in FIG. 2) coupled to the atmospheric port of the bellows may be actuated to a closed position and a second valve, V2 (such as second valve 288 in FIG. 2) coupled to a junction of a vent line and a vapor line (such as vapor line 299 in FIG. 2) may be actuated to an open position. By opening V2, a fluidic communication may be established between an ELCM system (such as ELCM 295 in FIG. 2) and the vapor line. By closing V1, communication between the ELCM system and the bellows is severed. Also, a canister vent valve (such as CVV 229 in FIG. 2) housed in the vent line between the ELCM and a fuel vapor canister may be actuated to a closed position to isolate the canister from the ELCM. Further a fuel tank isolation valve (such as FTIV 252 in FIG. 2) may be closed to discontinue fluidic communication between the fuel tank and the canister.

At 410, the changeover valve (Such as COV 313 in FIG. 3B) may be actuated to a closed position (such as shown in FIG. 3B) to establish fluidic communication of the ELCM pump (such as pump 330 in FIG. 3B) with the vent line. Due to the closing of the CVV and opening of the V2, the ELCM pump may be fluidically coupled to the vapor line between the bellows and the vent line. The ELCM pump may then be operated in a vacuum mode. The ELCM vacuum pump may be a reversible vacuum pump, and thus configured to apply a negative pressure to the vapor when a bridging circuit is reversed. Upon operation of the ELCM pump, the vapor line may be evacuated.

As the vapor line is being evacuated, at 412, the pressure at the ELCM (ELCM pressure, P1) as estimated via the ELCM pressure sensor may be monitored for a first threshold duration. The ELCM pressure may be equal to the pressure in the vapor line. The first threshold duration may be calibrated based on a time needed by the ELCM pump to evacuate the vapor line to a first threshold pressure level (Th1). The first threshold pressure level may be a pre-calibrated pressure level based on geometry of the fuel system.

At 414, the routine includes determining if the ELCM pressure P1 has reduced to the first threshold pressure (Th1) within the first threshold duration. If it is determined that the P1 has not reduced to Th1 within the first threshold duration, it may be inferred that there is a degradation such as a leak in the vapor line. At 416, the degradation in the vapor line may be indicated such as by raising a flag and setting a diagnostic code. The operator may be notified via an indication in the vehicle dash board. Further diagnostics of the bellows may be aborted. At 418, in response to the detection of degradation of the vapor line, vehicle operation may be adjusted during subsequent engine cycles until the vapor line is serviced. Example adjustments to the vehicle operation may include operating the vehicle in an electric drive mode, where only a motor may propel drive wheels of the vehicle so that the fueling system is not relied upon to power the engine. Due to the fuel pump not being active, agitation of fuel in the tank may be reduced, thereby reducing the possibility of fuel entering the bellows and fuel vapor forming within the vapor line.

If it is determined that the P1 has reduced to Th1 within the first threshold duration, it may be inferred that the vapor line has been evacuated and there is no degradation in the vapor line. The bellows diagnostics may be carried forward. At 420, V1 may be actuated to an open position. With both V1 and V2 open, the ELCM pump is fluidically coupled to the bellows. As the ELCM pump is continued to be operated, the bellows may be evacuated via the vapor line.

At 422, the pressure at the ELCM, P1 (ELCM pressure) as estimated via the ELCM pressure sensor may be monitored for a second threshold duration and the pressure within the fuel tank, P2 (outside the bellows) as estimated via a fuel tank pressure sensor (such as FTPT 156 in FIG. 2) may be monitored over the second threshold duration. The ELCM pressure may be equal to the pressure in the bellows. The second threshold duration may be calibrated based on a time needed by the ELCM pump to evacuate the bellows to a second threshold pressure level (Th2). The second threshold pressure level may be a pre-calibrated pressure level based on geometry of the bellows. In one example, since the volume of the bellows may be higher than the vapor line, the time to evacuate the bellows (second threshold duration) may be higher than the time to evacuate the vapor line alone (first threshold duration).

In one example, based on the material of the bellows, the bellows may be stiff (not compliant) such as during cold weather conditions. If the bellows are stiff, as the air is sucked out of the bellows via the atmospheric port, the size and shape of the bellows may not change and the sections of the bellows may not collapse. Due to the shape and size of the bellows not changing, the vapor pressure in the fuel tank (outside the bellows) may not change significantly (such as more than 10%) and the pressure estimated via a fuel tank pressure sensor may not record a substantial change in fuel tank pressure. The pressure at the bellows may continue to drop during the evacuation and the drop in pressure may be recorded by the ELCM pressure sensor.

In another example, based on the material of the bellows, the bellows may be compliant (not stiff) such as during warm weather conditions. If the bellows are compliant, as the air is sucked out of the bellows via the atmospheric port, the sections of the bellows may collapse and the size of the bellows may shrink. Due to shrinking of the bellows within the sealed fuel tank, the vapor space inside the fuel tank may increase. As the vapor space within the fuel tank increases, the pressure within the fuel tank, estimated via the fuel tank pressure sensor, may record a decrease in fuel tank pressure. Also, the pressure at the bellows may continue to drop during the evacuation and the drop in pressure may be recorded by the ELCM pressure sensor. In this way, both the pressure at the bellows and the pressure in the fuel tank may decrease during the evacuation but the rate of change of pressure at the bellows may be different from the rate of change in fuel tank pressure.

FIG. 5 shows an example 500 of a change in ELCM pressure, P1 which is equivalent to the pressure in the bellows over time when the bellows is stiff. The first plot, line 502, shows a change in ELCM pressure estimated by the ELCM pressure sensor. Dashed line 505 denotes the second threshold pressure level (Th2). The second plot, line 504, shows a change in fuel tank pressure P2 as estimated via a fuel tank pressure sensor. The x-axis shows time and the marker T2 denotes the second threshold duration (from origin).

As the ELCM pump operates and the bellows is evacuated, for the stiff bellows which does not change shape and size over time, the pressure P1 drops steadily and smoothly without any significant choppiness. The pressure P1 reduces to the second threshold prior to time T2. Also, due to the bellows not changing size significantly, the pressure P2 in the fuel tank does not change significantly.

FIG. 6 shows an example 600 of a change in ELCM pressure, P1 which is equivalent to the pressure in the bellows over time when the bellows is compliant. The first plot, line 602, shows a change in ELCM pressure estimated by the ELCM pressure sensor. Dashed line 505 denotes the second threshold pressure level (Th2). The second plot, line 604, shows a change in fuel tank pressure P2 as estimated via a fuel tank pressure sensor. The x-axis shows time and the marker T2 denotes the second threshold duration (from origin).

As the ELCM pump operates and the bellows is evacuated, for the compliant bellows which changes shape and size over time, the pressure P1 drops in steps. As seen in this example, a first section of the bellows collapses at C1 causing a first change in the 602 plot, a second section of the bellows collapses at C2 causing a second change in the 602 plot, and a third section of the bellows collapses at C3 causing a third change in the 602 plot. Even with all the steps and choppiness, the pressure P2 reduces to the second threshold prior to time T2. Due to the bellows changing size with each section collapsing, the pressure P2 in the fuel tank changes significantly. P2 decreases in steps with the change in P1. The rate of change in P2 is different from the rate of change in P1.

Returning to FIG. 4A, at 424, the routine includes determining if the ELCM pressure, P1 (which is equivalent to the pressure at the bellows) has decreased to the second threshold pressure within the second threshold duration, Th2 and if the fuel tank pressure, P2 is substantially constant (such as within 10% variation) over the duration of evacuation of the bellows. If it is confirmed that P1 has reduced to Th2 within the second threshold duration and P2 has remained substantially constant, it may be inferred that the bellows are stiff and while the bellows are being successfully evacuated, the size of the bellows has not changed significantly. In a stiff bellows, the pressure in the bellows may decrease steadily without distinct steps (smooth decrease and not choppy). Also, since it was possible to evacuate the bellows, it may be inferred that there are no degradations such as leaks in the bellows. At 426, the routine may indicate that the bellows are not degraded. Since the bellows are robust, engine operation need not be altered to compensate for degradation in the bellows. At 428, the ELCM pump may be deactivated upon completion of the diagnostics. The first valve V1 and the second valve V2 may be maintained in respective open positions. Method 400 ends.

If at 424 it is determined that P1 has not reduced to Th2 within the second threshold duration and P2 has not remained substantially constant, the routine may continue to step 432 in FIG. 4B. At 432, the routine includes determining if P1 has reduced to Th2 in steps and if P2 was decreasing in steps within the second threshold duration. If the bellows is compliant, as the air is sucked out, the sections may collapse. Each collapse of a section may correspond to a change in the slope of a P1 vs time plot. The changes in rate of change in pressure during the evacuation upon each section collapsing may give rise to steps in the P1 vs time plot (as seen in FIG. 6). Also, with the decrease in bellows size (volume), the vapor space in the fuel tank increases and the fuel tank pressure decreases. The decrease in P2 may also follow the steps corresponding to the change in P1 with each section collapsing.

If it is determined that P1 has reduced to Th2 in steps and P2 was decreasing in steps within the second threshold duration, it may be inferred that the bellows are compliant and while the bellows are being successfully evacuated, the size of the bellows changed significantly due to collapsing of sections. In a compliant bellows, the pressure in the bellows may decrease with distinct steps (not smooth decrease). Also, since it was possible to evacuate the bellows, it may be inferred that there are no degradations such as leaks in the bellows. At 434, the routine may indicate that the bellows are not degraded. Upon completion of the diagnostic routine, at 436, the ELCM pump may be deactivated. The COV within the ELCM may be opened. The first valve V1 and the second valve V2 may be maintained in their respective open positions to continue fluidic communication between the atmospheric port of the bellows and the vent line. Method 400 ends.

If it is determined that P1 has not reduced to Th2 in steps or smoothly within the second threshold duration, it may be inferred that the bellows are degraded. Since it was previously confirmed that the vapor line is not degraded, the degradation is confirmed to be within the bellows. As an example, the bellows may include one or more leaks which prevents evacuation of the bellows. At 440, the degradation in the bellows may be indicated such as by raising a flag and setting a diagnostic code. The operator may be notified via an indication in the vehicle dash board. Additionally or alternatively, the driver indication may include lighting a malfunction indicator lamp (MIL) and the diagnostic code may be set and stored in the memory of the engine controller. In one example, lighting the MIL may indicate a request that the vehicle be taken to a service technician, and the diagnostic code that is set may indicate to the service technician that the bellows included in the fuel tank is degraded. The light and the code may reset after the vehicle has been serviced and the degraded bellows has been replaced or repaired.

Upon completion of the diagnostics and detection of degradation of the bellows, at 442, the ELCM pump may be deactivated and the COV may be reopened. At 444, in order to isolate the degraded bellows from the vent line and inhibit flow of fuel vapors from within the bellow to the atmosphere via the vent line, each of the first valve V1 and the second valve V2 may be actuated to their respective closed positions. Also, the FTIV coupling the fuel tank to the fuel vapor canister may be adjusted to a fully open position to vent at least some of the fuel vapor in the fuel tank.

When the bellows are degraded, at least a portion of the liquid fuel may enter into the bellows and at least a portion of the fuel vapor in the fuel tank may escape through the atmospheric port and the vapor line coupled to the bellows. Accordingly, to mitigate an amount of untreated fuel vapors escaping from the fuel tank, at 446, one or more of the vehicle operating parameters that generate excess fuel vapors may be altered or adjusted. The engine controller may command the vehicle enter an electric drive mode, where only a motor may propel drive wheels of the vehicle so that the fueling system is not relied upon to power the engine. Due to the fuel tank not being active, agitation of fuel in the tank may be reduced, thereby reducing the possibility of fuel entering the bellows and fuel vapor forming within the bellows. If engine is operated, the engine torque demand may be reduced to reduce fuel pump duty cycle and consequent heating from the pump. Additionally, the driver indication may include an advisory against refilling the fuel tank to above the threshold fuel level and parking the vehicle on an inclined slope greater than a threshold incline, such as 6%. Further, the driver may be instructed to park the vehicle in a shade to reduce vaporization of fuel due to hot ambient conditions (from solar heat). The one or more vehicle operating conditions may remain altered or adjusted until servicing of the fuel system may be performed and the bellows of the fuel tank is repaired. Method 400 ends.

In this way, in response to conditions being met for diagnostics of a bellows included within a pressure-less fuel tank, an evaporative emissions control (EVAP) system leak detection module (ELCM) may be isolated from a fuel vapor canister, the ELCM may be coupled to the bellows via a vapor line, the bellows may be evacuated by operating a pump of the ELCM in a vacuum mode, and in response to a pressure at the bellows not reducing to a threshold pressure, degradation of the bellows may be indicated, and operation of the vehicle during subsequent drive cycles may be adjusted.

Turning now to FIG. 7, map 700 depicts a prophetic example of diagnostics of a bellows (such as bellows 291 in FIG. 2) included within a fuel tank of an engine. The horizontal (x-axis) denotes time and the vertical markers t1-t3 identify significant times in the routine for bellows diagnostics carried out during an engine-off condition.

The first plot, line 702, depicts conditions being met for carrying out diagnostics of the bellows. The conditions include an engine operating status and a fuel level. The engine may be on when fuel and air is combusted in engine cylinders to generate torque for vehicle propulsion. The engine may be off when the vehicle may be stationary or when the vehicle is being propelled via torque from an onboard electric motor while combustion is not carried out in the engine. The conditions for carrying out the diagnostics are met upon the engine being off and a fuel level in the fuel tank not contacting the bellows (fuel level below 40% capacity). The second plot, line 704, depicts operation of an ELCM pump (such as ELCM pump 330 in FIG. 3B) as a vacuum pump to generate vacuum in a fuel system component. The third plot, line 706, shows a position of a change-over valve (such as COV 313 in FIG. 3B). In a closed position of the COV, a fluidic communication may be established between the ELCM pump and the vent line. The fourth plot, line 708, shows a position of a first valve (such as V1 286 in FIG. 2) coupled to the atmospheric port of the bellows to regulate fluidic communication between the bellows and a vapor line (such as vapor line 299 in FIG. 2) leading to a vent line (such as vent line 227 of FIG. 2). The fifth plot, line 710, shows a position of a second valve (such as V2 288 in FIG. 2) coupled to a junction of the vapor line and the vent line. The sixth plot, line 712, shows a change in ELCM pressure as estimated via an ELCM pressure sensor (such as ELCM pressure sensor 396 in FIG. 3B). During the diagnostics, due to the coupling of the ELCM pump and bellows via the vapor line, the ELCM pressure may be same as that within the bellows. A first threshold ELCM pressure at which the diagnostics of the bellows can be initiated is shown by dashed line 715. Dashed line 717 denotes a second threshold ELCM pressure which may be attained at the bellows during the diagnostic routine to confirm robustness of the bellows. The seventh plot, line 720, shows a fuel tank pressure, as estimated via a fuel tank pressure sensor (such as FTPT 156 in FIG. 2). The eighth plot, line 722, shows a position of a flag indicating degradation of the bellows. In the On position, the flag indicates degradation of the bellows.

Prior to time t1, conditions for carrying out the bellows diagnostics are not met such as the engine is running. The ELCM pump is maintained deactivated and the ELCM pressure is not actively monitored. The COV valve is in an open position. The V1 and V2 valves are maintained open. Since any degradation of the bellows is not yet detected, the flag is maintained in an off position.

At time t1, in response to conditions being met for carrying out the diagnostics of the bellows, the ELCM pump is activated to operate as a vacuum pump. The COV is actuated to a closed position and V1 is actuated to a closed position. With V1 and COV closed, the vapor line is evacuated for a first threshold duration such as the time period between time t1 and t2. The drop in pressure in the vapor line is monitored as the change in ELCM pressure. Once the vapor line is evacuated and the ELCM pressure reduces to the first threshold pressure within the first threshold duration such as by time t2, it is inferred that the vapor line is robust and diagnostics of the bellows can be initiated.

At time t2, the V1 is actuated to an open position to establish fluidic communication between the ELCM pump and the bellows via the vapor line. The ELCM pump is continued to be operated as the bellows is evacuated for a second threshold duration such as the time period between time t2 and t3. It is observed that the ELCM pressure reduces in steps and also the fuel tank pressure (FTPT reading) reduces in steps. The ELCM pressure reaches the second threshold pressure 717 before the completion of the second threshold duration (prior to time t3). Therefore, it can be inferred that the bellows are compliant and robust causing sections of the bellows to collapse during the evacuation and a desired level of vacuum is generated in the bellows. In response, to the indication that the bellows is not degraded, the flag is maintained in the off position. At time t3, upon completion of the diagnostic routine, the ELCM pump is deactivated and the COV is actuated to an open position.

In an alternate example, if the ELCM pressure decreased steadily and reached the second threshold pressure 717 prior to time t3, such as shown by dotted line 714, and the fuel tank pressure remained substantially constant over the second threshold duration, such as shown by dashed line 718, it would have been inferred that bellows are stiff and robust causing the bellows to hold its original shape (and size) during the evacuation and a desired level of vacuum is generated in the bellows. The flag may have been continued to be maintained in an off condition.

In yet another example, if the ELCM pressure did not reach the second threshold pressure 717 prior to time t3, such as shown by dashed line 716, it would have been inferred that the bellows is degraded and due to the degradation such as leaks, the ELCM pump was not able to evacuate the bellows within the second threshold duration. In response to the detection of degradation, at time t3, the flag would have been set to an on position, such as shown by dashed line 724.

In this way, by opportunistically operating the ELCM pump to evacuate the bellows within a pressure-less fuel tank, any leaks in the bellows may be detected and mitigating actions may be taken. By taking suitable mitigating actions, it may be ensured that undesired fuel vapor do not escape to the atmosphere from the degraded bellows. Overall, by providing a reliable diagnostic routine for detection of degradation/leaks in bellows, it may be ensured that current and future degradation detection regulations are met and cost efficient pressure-less fuel tank systems may be used more universally.

An example method for an engine comprises: operating a pump of an evaporative emissions control (EVAP) system leak detection module (ELCM), and detecting degradation of a bellows within a fuel tank based on a change in pressure at the bellows. In the preceding example, additionally or optionally, the operation of the pump is during an engine-off condition when fuel contained in the fuel tank is not contacting a surface of the bellows. In any or all of the preceding examples, additionally or optionally, an atmospheric port of the bellows is coupled to a vent line upstream of the ELCM via a vapor line, the vapor line including a first valve coupled to a first end proximal to the atmospheric port and a second valve coupled to a second end proximal to the vent line. Any or all of the preceding examples, further comprising, additionally or optionally, prior to operating the pump, closing a changeover valve (COV) housed within the ELCM, and closing a canister vent valve (CVV) housed in the vent line between the ELCM and a fuel vapor canister to isolate the ELCM from the fuel vapor canister, opening the second valve and closing the first valve to fluidically couple the ELCM to the vapor line, and then activating the pump in a vacuum mode. Any or all of the preceding examples, further comprising, additionally or optionally, monitoring a pressure at the vapor line via an ELCM pressure sensor for a first threshold duration, and in response to the pressure at the vapor line decreasing to a first threshold pressure within the first threshold duration, opening the first valve to fluidically couple the bellows to the ELCM, and monitoring the change in pressure at the bellows via the ELCM pressure sensor for a second threshold duration. Any or all of the preceding examples, further comprising, additionally or optionally, in response to the pressure at the vapor line not decreasing to the first threshold pressure within the first threshold duration, indicating degradation of the vapor line and discontinuing diagnostics of the bellows. In any or all of the preceding examples, additionally or optionally, detecting degradation of the bellows includes, in response to the pressure at the bellows not reducing to a second threshold pressure within the second threshold duration, indicating degradation of the bellows and setting a diagnostic code. Any or all of the preceding examples, further comprising, additionally or optionally, in response to detection of degradation of the bellows, closing the first valve to disable communication between the bellows and the vent line, and opening a fuel tank isolation valve (FTIV) housed in a conduit connecting the fuel tank to the fuel vapor canister. Any or all of the preceding examples, further comprising, additionally or optionally, in response to the pressure at the bellows smoothly reducing to the second threshold pressure within the second threshold duration and a fuel tank pressure remaining substantially constant over the second threshold duration, indicating the bellows to be stiff and not degraded. Any or all of the preceding examples, further comprising, additionally or optionally, in response to the pressure at the bellows reducing to the second threshold pressure within the second threshold duration in steps and the fuel tank pressure reducing over the second threshold duration, indicating the bellows to be compliant and not degraded.

Another example method for an engine in a vehicle, comprises: in response to conditions being met for diagnostics of a bellows included within a pressure-less fuel tank, isolating an evaporative emissions control (EVAP) system leak detection module (ELCM) from a fuel vapor canister, coupling the ELCM to the bellows via a vapor line, evacuating the bellows by operating a pump of the ELCM in a vacuum mode, in response to a pressure at the bellows not reducing to a threshold pressure, indicating degradation of the bellows, and adjusting operation of the vehicle during subsequent drive cycles. In the preceding example, additionally or optionally, the conditions for diagnostics of the bellows include an engine-off condition and a fuel level in the fuel tank being lower than a threshold fuel level, fuel in the fuel tank not contacting any surface of the bellows upon full expansion of the bellows at the threshold fuel level. In any or all of the preceding examples, additionally or optionally, the isolating the ELCM from the fuel vapor canister includes closing a changeover valve (COV) included within the ELCM, closing a canister vent valve (CVV) housed in a vent line of the EVAP system between the ELCM and the fuel vapor canister, and closing a fuel tank isolation valve (FTIV) coupling the fuel tank to the fuel vapor canister. In any or all of the preceding examples, additionally or optionally, coupling the ELCM to the bellows via the vapor line includes opening a first valve coupled to a first junction of an atmospheric port of the bellows and the vapor line and opening a second valve coupled to a second junction of the vapor line and the vent line. Any or all of the preceding examples, further comprising, additionally or optionally, during evacuating the bellows, monitoring the pressure at the bellows over a threshold duration via a pressure sensor of the ELCM and monitoring a pressure in the fuel tank over the threshold duration via a fuel tank pressure sensor. Any or all of the preceding examples, further comprising, additionally or optionally, indicating the bellows is not degraded in response to the pressure at the bellows reducing to the threshold pressure within the threshold duration. In any or all of the preceding examples, additionally or optionally, adjusting operation of the vehicle includes, during subsequent drive cycles, propelling the vehicle with motor torque and not refilling the fuel tank to above the threshold fuel level.

Another example for a vehicle, comprises: a variable volume device disposed within a fuel tank, an atmospheric port of the variable volume device fluidly coupled to a vent line upstream of an evaporative leak detection module (ELCM) of an evaporative emissions control (EVAP) system via a vapor line, the vent line coupling a fuel vapor canister of the EVAP system to atmosphere, and a controller with computer-readable instructions stored on non-transitory memory which when executed cause the controller to: fluidically couple a pump of the ELCM to the variable volume device via the vapor line, operate the pump to evacuate the variable volume device over a threshold duration, and indicate the variable volume device as robust or degraded based on a first pressure estimated via an ELCM pressure sensor and a second pressure estimated via a fuel tank pressure sensor. In any of the preceding examples, additionally or optionally, the vapor line includes each of a first valve coupled to a first junction of the atmospheric port and the vapor line, and a second valve coupled to a second junction of the vapor line and the vent line, each of the first valve and the second valve maintained in respective open positions while a canister vent valve (CVV) connecting the pump to the fuel vapor canister is maintained in a closed position during the operation of the pump. In any or all of the preceding examples, additionally or optionally, the indication of the variable volume device to be robust is in response to the first pressure reducing to a threshold pressure within the threshold duration, and wherein the indication of the variable volume device to be degraded is in response to the first pressure not reducing to the threshold pressure within the threshold duration and a change in the second pressure following a change in the first pressure.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

operating a pump of an evaporative emissions control (EVAP) system leak detection module (ELCM), and detecting degradation of a bellows within a fuel tank based on a change in pressure at the bellows.

2. The method of claim 1, wherein the operation of the pump is during an engine-off condition when fuel contained in the fuel tank is not contacting a surface of the bellows.

3. The method of claim 1, wherein an atmospheric port of the bellows is coupled to a vent line upstream of the ELCM via a vapor line, the vapor line including a first valve coupled to a first end proximal to the atmospheric port and a second valve coupled to a second end proximal to the vent line.

4. The method of claim 3, further comprising, prior to operating the pump, closing a changeover valve (COV) housed within the ELCM, and closing a canister vent valve (CVV) housed in the vent line between the ELCM and a fuel vapor canister to isolate the ELCM from the fuel vapor canister, opening the second valve and closing the first valve to fluidically couple the ELCM to the vapor line, and then activating the pump in a vacuum mode.

5. The method of claim 4, further comprising, monitoring a pressure at the vapor line via an ELCM pressure sensor for a first threshold duration, and in response to the pressure at the vapor line decreasing to a first threshold pressure within the first threshold duration, opening the first valve to fluidically couple the bellows to the ELCM, and monitoring the change in pressure at the bellows via the ELCM pressure sensor for a second threshold duration.

6. The method of claim 5, further comprising, in response to the pressure at the vapor line not decreasing to the first threshold pressure within the first threshold duration, indicating degradation of the vapor line and discontinuing diagnostics of the bellows.

7. The method of claim 5, wherein detecting degradation of the bellows includes, in response to the pressure at the bellows not reducing to a second threshold pressure within the second threshold duration, indicating degradation of the bellows and setting a diagnostic code.

8. The method of claim 7, further comprising, in response to detection of degradation of the bellows, closing the first valve to disable communication between the bellows and the vent line, and opening a fuel tank isolation valve (FTIV) housed in a conduit connecting the fuel tank to the fuel vapor canister.

9. The method of claim 7, further comprising, in response to the pressure at the bellows smoothly reducing to the second threshold pressure within the second threshold duration and a fuel tank pressure remaining substantially constant over the second threshold duration, indicating the bellows to be stiff and not degraded.

10. The method of claim 9, further comprising, in response to the pressure at the bellows reducing to the second threshold pressure within the second threshold duration in steps and the fuel tank pressure reducing over the second threshold duration, indicating the bellows to be compliant and not degraded.

11. A method for an engine in a vehicle, comprising:

in response to conditions being met for diagnostics of a bellows included within a pressure-less fuel tank;

isolating an evaporative emissions control (EVAP) system leak detection module (ELCM) from a fuel vapor canister;

coupling the ELCM to the bellows via a vapor line;

evacuating the bellows by operating a pump of the ELCM in a vacuum mode;

in response to a pressure at the bellows not reducing to a threshold pressure, indicating degradation of the bellows; and adjusting operation of the vehicle during subsequent drive cycles.

12. The method of claim 11, wherein the conditions for diagnostics of the bellows include an engine-off condition and a fuel level in the fuel tank being lower than a threshold fuel level, fuel in the fuel tank not contacting any surface of the bellows upon full expansion of the bellows at the threshold fuel level.

13. The method of claim 11, wherein the isolating the ELCM from the fuel vapor canister includes closing a changeover valve (COV) included within the ELCM, closing a canister vent valve (CVV) housed in a vent line of the EVAP system between the ELCM and the fuel vapor canister, and closing a fuel tank isolation valve (FTIV) coupling the fuel tank to the fuel vapor canister.

14. The method of claim 13, wherein coupling the ELCM to the bellows via the vapor line includes opening a first valve coupled to a first junction of an atmospheric port of the bellows and the vapor line and opening a second valve coupled to a second junction of the vapor line and the vent line.

15. The method of claim 11, further comprising, during evacuating the bellows, monitoring the pressure at the bellows over a threshold duration via a pressure sensor of the ELCM and monitoring a pressure in the fuel tank over the threshold duration via a fuel tank pressure sensor.

16. The method of claim 11, further comprising, indicating the bellows is not degraded in response to the pressure at the bellows reducing to the threshold pressure within the threshold duration.

17. The method of claim 11, wherein adjusting operation of the vehicle includes, during subsequent drive cycles, propelling the vehicle with motor torque and not refilling the fuel tank to above the threshold fuel level.

18. A system for a vehicle, comprising:

a variable volume device disposed within a fuel tank;

an atmospheric port of the variable volume device fluidly coupled to a vent line upstream of an evaporative leak detection module (ELCM) of an evaporative emissions control (EVAP) system via a vapor line, the vent line coupling a fuel vapor canister of the EVAP system to atmosphere; and a controller with computer-readable instructions stored on non-transitory memory which when executed cause the controller to:

fluidically couple a pump of the ELCM to the variable volume device via the vapor line;

operate the pump to evacuate the variable volume device over a threshold duration; and indicate the variable volume device as robust or degraded based on a first pressure estimated via an ELCM pressure sensor and a second pressure estimated via a fuel tank pressure sensor.

19. The system of claim 18, wherein the vapor line includes each of a first valve coupled to a first junction of the atmospheric port and the vapor line, and a second valve coupled to a second junction of the vapor line and the vent line, each of the first valve and the second valve maintained in respective open positions while a canister vent valve (CVV) connecting the pump to the fuel vapor canister is maintained in a closed position during the operation of the pump.

20. The system of claim 18, wherein the indication of the variable volume device to be robust is in response to the first pressure reducing to a threshold pressure within the threshold duration, and wherein the indication of the variable volume device to be degraded is in response to the first pressure not reducing to the threshold pressure within the threshold duration and a change in the second pressure following a change in the first pressure.

* * * * *